US012123415B2

(12) United States Patent
Sakai et al.

(10) Patent No.: US 12,123,415 B2
(45) Date of Patent: Oct. 22, 2024

(54) SCROLL COMPRESSOR HOUSING WITH FIN ARRANGEMENT

(71) Applicant: MITSUBISHI HEAVY INDUSTRIES THERMAL SYSTEMS, LTD., Tokyo (JP)

(72) Inventors: Masayuki Sakai, Tokyo (JP); Tatsuo Ishiguro, Tokyo (JP); Hitoshi Tamaki, Tokyo (JP); Hajime Sato, Tokyo (JP); Hirofumi Hirata, Tokyo (JP); Makoto Takeuchi, Tokyo (JP); Takuma Kondo, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 18/028,409

(22) PCT Filed: Oct. 15, 2021

(86) PCT No.: PCT/JP2021/038262

§ 371 (c)(1),
(2) Date: Mar. 24, 2023

(87) PCT Pub. No.: WO2022/080488

PCT Pub. Date: Apr. 21, 2022

(65) Prior Publication Data

US 2023/0358234 A1 Nov. 9, 2023

(30) Foreign Application Priority Data

Oct. 16, 2020 (JP) ..... 2020-174866

(51) Int. Cl.
*F04C 29/04* (2006.01)
*F04C 18/02* (2006.01)

(52) U.S. Cl.
CPC ..... *F04C 29/04* (2013.01); *F04C 18/0207* (2013.01); *F04C 2240/30* (2013.01)

(58) Field of Classification Search
CPC ..... F04C 29/04; F04C 18/0207; F04C 2240/30; F04C 23/008; F04C 18/0215
(Continued)

(56) References Cited

U.S. PATENT DOCUMENTS

2001/0025701 A1* 10/2001 Ikeda ..... H01L 23/467 174/15.2
2002/0039532 A1* 4/2002 Saito ..... F04C 29/045 417/410.5

FOREIGN PATENT DOCUMENTS

JP H07119672 A * 5/1995
JP 8-195456 A 7/1996
(Continued)

OTHER PUBLICATIONS

JP-2007224809-A translation (Year: 2024).*
(Continued)

*Primary Examiner* — J. Todd Newton
(74) *Attorney, Agent, or Firm* — Birch, Stewart, Kolasch & Birch, LLP

(57) ABSTRACT

This scroll compressor comprises: a shaft that is capable of rotating about an axis; a motor that rotatably drives the shaft; a compressor body that is driven by the rotation of the shaft; a housing that covers the motor and the compressor body and that has a bottom surface facing the motor from the axial direction; an intake port that guides a refrigerant into the housing; and heat-dissipating fins that are formed on the bottom surface, that extend in the direction in which the refrigerant flows, and that are divided in the flow direction.

4 Claims, 5 Drawing Sheets

(58) Field of Classification Search
USPC ..... 418/55.1
See application file for complete search history.

(56) References Cited

FOREIGN PATENT DOCUMENTS

| | | | | |
|---|---|---|---|---|
| JP | 11-317482 | A | | 11/1999 |
| JP | 2002-33421 | A | | 1/2002 |
| JP | 2006-9778 | A | | 1/2006 |
| JP | 3976512 | B2 | | 9/2007 |
| JP | 2007224809 | A | * | 9/2007 |
| JP | 2012-47140 | A | | 3/2012 |
| JP | 2022047260 | A | * | 3/2022 |
| JP | 2022065800 | A | * | 4/2022 |
| KR | 10-2011-0072323 | A | | 6/2011 |

OTHER PUBLICATIONS

JP-2022047260-A translation (Year: 2024).*
JP-2022065800-A translation (Year: 2024).*
JP-H07119672-A translation (Year: 2024).*
International Search Report for International Application No. PCT/JP2021/038262, dated Dec. 7, 2021, with English translation.
Written Opinion of International Searching Authority for International Application No. PCT/JP2021/038262, dated Dec. 7, 2021, with English translation.

* cited by examiner

SCROLL COMPRESSOR HOUSING WITH FIN ARRANGEMENT

TECHNICAL FIELD

The present disclosure relates to a scroll compressor. Priority is claimed on Japanese Patent Application No. 2020-174866 filed on Oct. 16, 2020, the content of which is incorporated herein by reference.

BACKGROUND ART

For example, a scroll compressor is known as a compressor used in a vehicle air conditioning device (see PTL 1 below). The scroll compressor includes a motor, a compressor body that is driven by the motor, and a housing that accommodates the motor and the compressor body.

In recent years, in order to reduce a size of the device, an example in which an intelligent power module (IPM) is used as an inverter circuit for driving the scroll compressor has been increasing. In this case, since a heat generation density is higher than that of the inverter circuit of the related art, it is necessary to improve cooling performance. In the device described in PTL 1, by providing a plurality of heat radiating fins on a rear surface side (back surface side) of the inverter in the housing, the cooling performance can be improved.

CITATION LIST

Patent Literature

[PTL 1] Japanese Patent No. 3976512

SUMMARY OF INVENTION

Technical Problem

However, in a case of providing the heat radiating fin as described above, there is a possibility in which the following problems arise depending on the shape and disposition thereof. For example, in a case where a bottom surface of the housing has deformed due to a pressure, there is a possibility in which a great stress is caused and damages the heat radiating fin. In addition, there is also a problem in that cracks and cavities are generated due to a thickness increase caused by forming the heat radiating fin when manufacturing the housing through casting.

The present disclosure is devised in order to solve the problems, and an object thereof is to provide a scroll compressor with improved cooling performance and strength.

Solution to Problem

According to an aspect of the present disclosure, in order to solve the problems, there is provided a scroll compressor including a shaft that is rotatable about an axis, a motor that rotationally drives the shaft, a compressor body that is driven by the rotation of the shaft, a housing that covers the motor and the compressor body and that has a bottom surface facing the motor from a direction of the axis, a suction port that guides a refrigerant into the housing, and a heat radiating fin that is formed on the bottom surface, that extends in a flowing direction of the refrigerant, and that is divided into a plurality of parts in the flowing direction.

Advantageous Effects of Invention

With the present disclosure, the scroll compressor with improved cooling performance and strength can be provided.

DESCRIPTION OF EMBODIMENTS (Configuration of Scroll Compressor)

Figure 1:
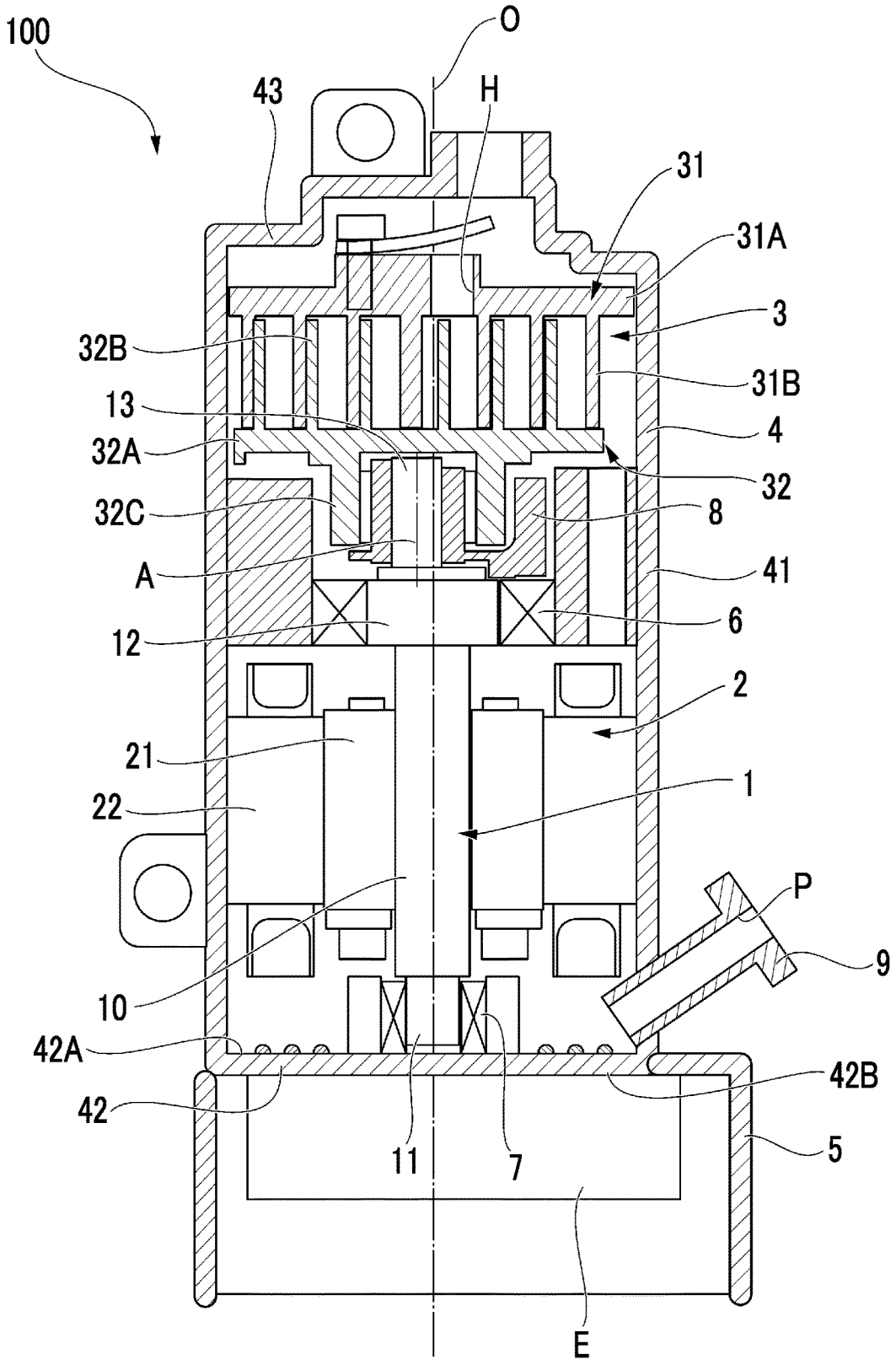
FIG. 1 is a vertical sectional view of a scroll compressor according to a first embodiment of the present disclosure.
Figure 2:
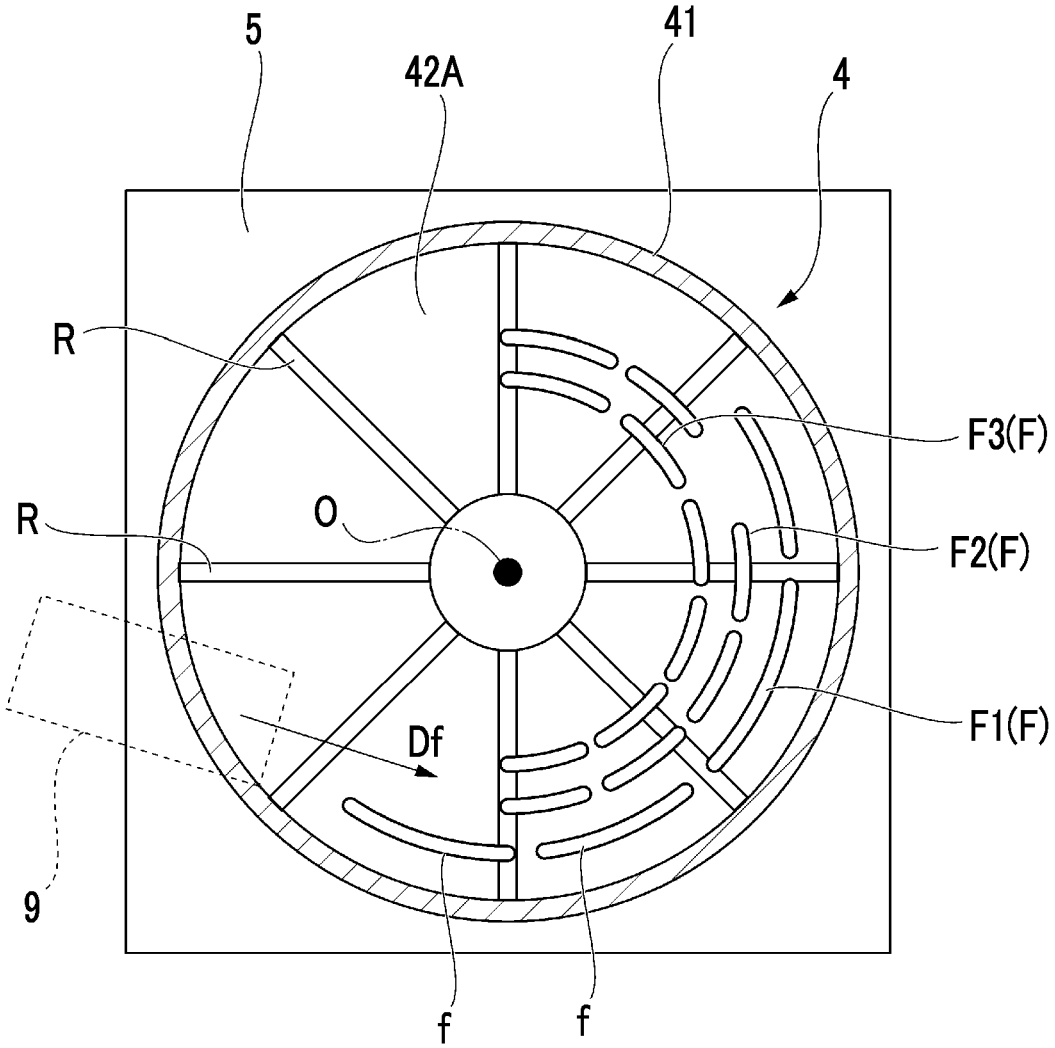
FIG. 2 is a view showing a configuration of a bottom surface of a housing according to the first embodiment of the present disclosure.

Hereinafter, a scroll compressor 100 according to an embodiment of the present disclosure will be described with reference to FIGS. 1 and 2. The scroll compressor 100 is used in order to compress, for example, a refrigerant for a vehicle air conditioning device. As shown in FIG. 1, the scroll compressor 100 includes a shaft 1, a motor 2, a compressor body 3, a housing 4, a cover 5, an upper bearing 6, a lower bearing 7, a drive bush 8, and a suction port 9.

(Configuration of Shaft)

The shaft 1 extends along an axis O and is rotatable about the axis O. The shaft 1 has a shaft body 10, a small-diameter portion 11, a large-diameter portion 12, and an eccentric shank 13. The shaft body 10 has a cylindrical shape about the axis O. The shaft body 10 has a uniform diameter dimension over the entire region in an axis O direction. A rotor 21 (to be described later) of the motor 2 is attached to an outer peripheral surface of the shaft body 10.

The small-diameter portion 11 is provided on one side (lower side) of the shaft body 10 in the axis O direction.

The small-diameter portion 11 has a cylindrical shape about the axis O and has a diameter dimension smaller than that of the shaft body 10. The small-diameter portion 11 is supported by the lower bearing 7 attached to the housing 4 from the one side (lower side) in the axis O direction.

The large-diameter portion 12 is provided on the other side (upper side) of the shaft body 10 in the axis O direction. The large-diameter portion 12 has a cylindrical shape about the axis O and has a diameter dimension larger than that of the shaft body 10. The large-diameter portion 12 is supported by the upper bearing 6 fixed to the housing 4 from a radial direction.

The eccentric shank 13 is provided on a further upper side (the other side in the axis O direction) of the large-diameter portion 12. The eccentric shank 13 protrudes from the large-diameter portion 12 toward the other side in the axis O direction. The eccentric shank 13 has a cylindrical shape about an eccentric axis A that is parallel to the axis O and that extends at a position shifted from the axis O in the radial direction. Therefore, when the shaft 1 rotates, the eccentric shank 13 revolves (turns) about the axis O.

(Configuration of Motor)

The motor 2 applies a rotational driving force to the shaft 1. The motor 2 has the rotor 21 and a stator 22. The rotor 21 is fixed to the shaft body 10. The rotor 21 has a cylindrical shape about the axis O. Although not shown in detail, the rotor 21 has a plurality of magnets. The stator 22 covers the rotor 21 from an outer peripheral side. In the stator 22, a plurality of steel plates are formed by being laminated in the axis O direction, and a plurality of coils are formed as a copper wire is wound around the steel plates.

By energizing the stator 22, an electromagnetic force is generated between the stator 22 and the rotor 21, and a rotational force about the axis O is applied to the rotor 21. Accordingly, the shaft 1 rotates about the axis O.

(Configuration of Compressor Body)

The compressor body 3 is driven by the rotation of the shaft 1 caused by the motor 2. The compressor body 3 has a fixed scroll 31 and a movable scroll 32. The fixed scroll 31 has a disk-shaped first end plate 31A about the axis O and a first spiral plate 31B provided on one side (lower side) of the first end plate 31A in the axis O direction. The first spiral plate 31B extends spirally about the axis O. The fixed scroll 31 is fixed to the housing 4.

The movable scroll 32 has a disk-shaped second end plate 32A, a second spiral plate 32B provided on the other side (upper side) of the second end plate 32A in the axis O direction, and a boss part 32C. The second spiral plate 32B extends spirally about the axis O. The dimension of the second spiral plate 32B in the axis O direction is equal to the dimension of the first spiral plate 31B described above in the axis O direction. As the first spiral plate 31B and the second spiral plate 32B mesh with each other from the axis O direction, a compression chamber is formed therebetween.

The boss part 32C is a cylindrical part protruding from the second end plate 32A toward the one side (lower side) in the axis O direction. The boss part 32C is attached to the eccentric shank 13 of the shaft 1 via the drive bush 8. As the eccentric shank 13 turns about the axis O, a turning force is transmitted to the movable scroll 32 through the drive bush 8. Accordingly, the movable scroll 32 turns about the axis O. Although not shown in detail, the rotation (spinning) of the movable scroll 32 itself is restricted by an Oldham ring.

As the movable scroll 32 turns, the volume of the compression chamber described above changes with time, a refrigerant is compressed while being sent from a radial outer side to an inner side in the compression chamber, and a pressure thereof increases. The refrigerant in a high-pressure state is guided into the housing 4 through an opening H formed in the first end plate 31A of the fixed scroll 31.

(Configurations of Housing and Cover)

The housing 4 is a bottomed cylindrical container that accommodates the shaft 1, the motor 2, and the compressor body 3. Specifically, the housing 4 has a cylindrical housing body 41 about the axis O, a bottom portion 42 that closes an opening of the housing body 41 on the one side in the axis O direction, a lid section 43 that closes an opening on the other side in the axis O direction, and the cover 5.

(Configurations of Rib and Heat Radiating Fin) Of both surfaces of the bottom portion 42 in a thickness direction, a surface facing the other side (that is, a motor 2 side) in the axis O direction is a bottom surface 42A. As shown in FIG. 2, a plurality of ribs R and a plurality of heat radiating fins F are formed on the bottom surface 42A.

The rib R protrudes from the bottom surface 42A toward the other side (upper side) in the axis O direction. The rib R extends radially about the axis O. For example, eight ribs R are provided. The rib R is provided in order to suppress deformation of the housing 4 caused by a pressure on a suction side.

The heat radiating fins F have an arc shape about the axis O and are arranged at intervals in the radial direction and a circumferential direction. That is, the heat radiating fins F are divided into a plurality of parts in the circumferential direction. In other words, each of the heat radiating fins F has a plurality of fin pieces f arranged in the circumferential direction. Like the rib R, the fin piece f protrudes from the bottom surface 42A toward the other side (upper side) in the axis O direction. The protruding height (that is, a dimension in the axis O direction) of the fin piece f is larger than the protruding height of the rib R.

The heat radiating fin F positioned on an outermost side in the radial direction is an outer peripheral heat radiating fin F1. The heat radiating fin F positioned on an innermost side in the radial direction is an inner peripheral heat radiating fin F3. The heat radiating fin F disposed between the outer peripheral heat radiating fin F1 and the inner peripheral heat radiating fin F3 is an intermediate heat radiating fin F2.

In the present embodiment, the number of divisions of the heat radiating fin F (the number of fin pieces f) increases from the outer peripheral heat radiating fin F1 toward the inner peripheral heat radiating fin F3. Further, the dimension of the fin piece f in the circumferential direction increases from the inner peripheral heat radiating fin F3 toward the outer peripheral heat radiating fin F1.

When viewed from the axis O direction, the outer peripheral heat radiating fin F1 extends over a region of approximately 180° about the axis O from an end portion of the suction port 9 to be described later. On the other hand, the intermediate heat radiating fin F2 and the inner peripheral heat radiating fin F3 extend over the region of approximately 180° about the axis O from a position in the circumferential direction, which is more separated from the suction port 9 than the outer peripheral heat radiating fin F1 is. Some of the heat radiating fins F overlap the ribs R in the circumferential direction. That is, some fin pieces f are formed integrally with the ribs R.

Referring back to FIG. 1, a surface of the bottom portion 42 on an opposite side to the bottom surface 42A (that is, a surface facing the outer side) is a back surface 42B. The cover 5 is attached to the back surface 42B. On the back surface 42B, an electrical component E including an intelligent power module (IPM) is disposed and is covered with the cover 5 from the outer side.

(Configuration of Suction Port)

The suction port 9 for guiding a refrigerant from the outside into the housing 4 is attached to the housing body 41. The suction port 9 communicates inside and outside the housing body 41 and guides the refrigerant toward the bottom surface 42A described above. Further, as shown in FIG. 2, the suction port 9 extends in a direction including a tangential direction component of a circle formed by the bottom surface 42A, when viewed from the axis O direction. Therefore, the refrigerant on the bottom surface 42A flows in the circumferential direction about the axis O. That is, the heat radiating fins F described above are arranged in a direction in which the refrigerant flows (an arrow Df in FIG. 2). In addition, the flow speed of the refrigerant is high on an outer peripheral side of the bottom surface 42A compared to an inner peripheral side. That is, since the outer peripheral heat radiating fin F1 has the fin piece f having a larger dimension in a flowing direction Df as described above, it can be said that the dimension of the fin piece f is larger in a region where the flow speed of the refrigerant is higher.

(Operational Effects)

Herein, in a case of providing the heat radiating fin F as described above, there is a possibility in which the following problems arise depending on the shape and disposition thereof. For example, in a case where the bottom surface 42A of the housing 4 has deformed due to a pressure on the suction side, there is a possibility in which a great stress is caused and damages the heat radiating fin F. In addition, there is also a problem in that defects including cracks and cavities are generated due to a thickness increase caused by forming the heat radiating fin F when manufacturing the housing 4 through casting.

However, in the present embodiment, the heat radiating fin F is divided into a plurality of parts in the flowing direction Df of the refrigerant. Accordingly, a boundary layer component of a flow along a surface of the heat radiating fin F is split in the flowing direction Df. As a result, a leading edge effect can be obtained a plurality of times for each heat radiating fin F. Therefore, a cooling effect of the bottom surface 42A (housing 4) caused by a refrigerant can be enhanced. (The leading edge effect described herein refers to a phenomenon in which thermal efficiency is highest at a part where a heat medium first collides.)

Further, in a case where the heat radiating fin F is not divided, there is a possibility in which a great stress is caused between a central portion of the heat radiating fin F and the bottom surface 42A and damages the heat radiating fin F due to the deformation of the bottom surface 42A. However, with the above configuration, since the heat radiating fin F is divided into a plurality of parts, a stress which is caused for each divided heat radiating fin F can be kept low even in a case where the bottom surface 42A has deformed. Accordingly, the strength of the housing 4 can be improved.

Further, with the above configuration, the dimension of the divided heat radiating fin F (fin piece f) in the flowing direction Df is larger in a region on the outer peripheral side in which the flow speed is higher. Accordingly, the leading edge effect can be generated an appropriate number of times in accordance with a flow speed distribution. As a result, the cooling effect of the bottom surface 42A (housing 4) caused by a refrigerant can be further enhanced.

In addition, with the above configuration, since the plurality of ribs R are provided, even in a case where a stress is caused at the bottom surface 42A (housing 4) due to a pressure on the suction side, it is possible to sufficiently resist against the stress. Further, the protruding height of the rib R from the bottom surface 42A is smaller than the protruding height of the heat radiating fin F. Accordingly, a probability in which the flow of the refrigerant at a tip of the heat radiating fin F is obstructed by the rib R can be reduced.

The first embodiment of the present disclosure has been described hereinbefore. It is possible to execute various changes and improvements in the configurations without departing from the gist of the present disclosure.

Figure 3:
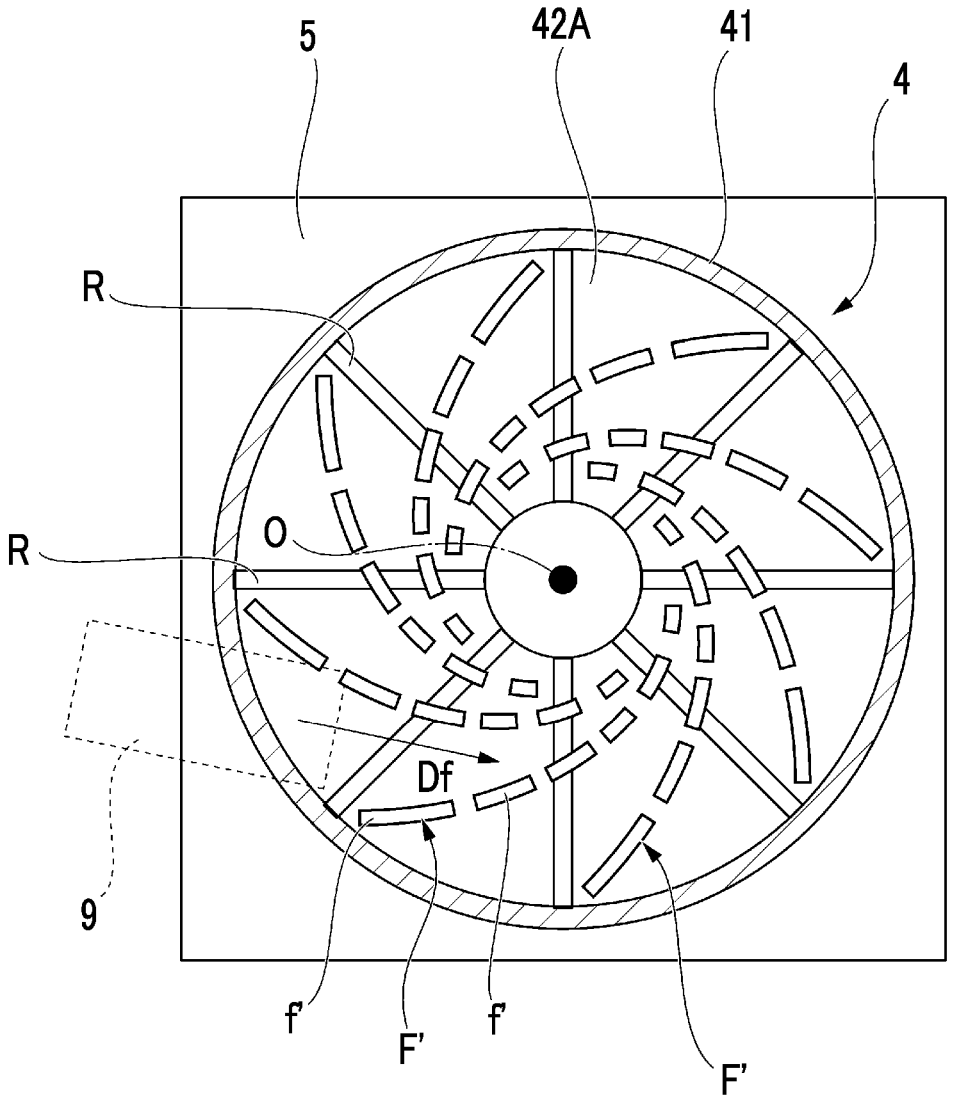
FIG. 3 is a view showing a modification example of the bottom surface of the housing according to the first embodiment of the present disclosure.

For example, as shown in FIG. 3, it is also possible to change the flowing direction Df (that is, a direction in which a heat radiating fin F' extends) of a refrigerant via the suction port 9. Specifically, each heat radiating fin F' extends toward the radial inner side from one side (that is, a side from which the refrigerant flows) toward the other side (a side to which the refrigerant flows away) in the circumferential direction. A plurality (eight) of such heat radiating fins F' are arranged at intervals in the circumferential direction. In addition, each heat radiating fin F' is divided into a plurality of parts in the flowing direction Df of the refrigerant. In other words, each of the heat radiating fins F' has a plurality of fin pieces f' arranged in the flowing direction Df. Of the plurality of fin pieces f', the fin piece f' on the outer peripheral side, on which the flow speed of the refrigerant is higher, has a larger dimension in the flowing direction Df. With such a configuration, the same operational effects as in the first embodiment can also be obtained.

Second Embodiment

Next, a second embodiment of the present disclosure will be described with reference to FIG. 4. The same configurations as those of the first embodiment will be assigned with the same reference signs, and detailed description thereof will be omitted.

Figure 4:
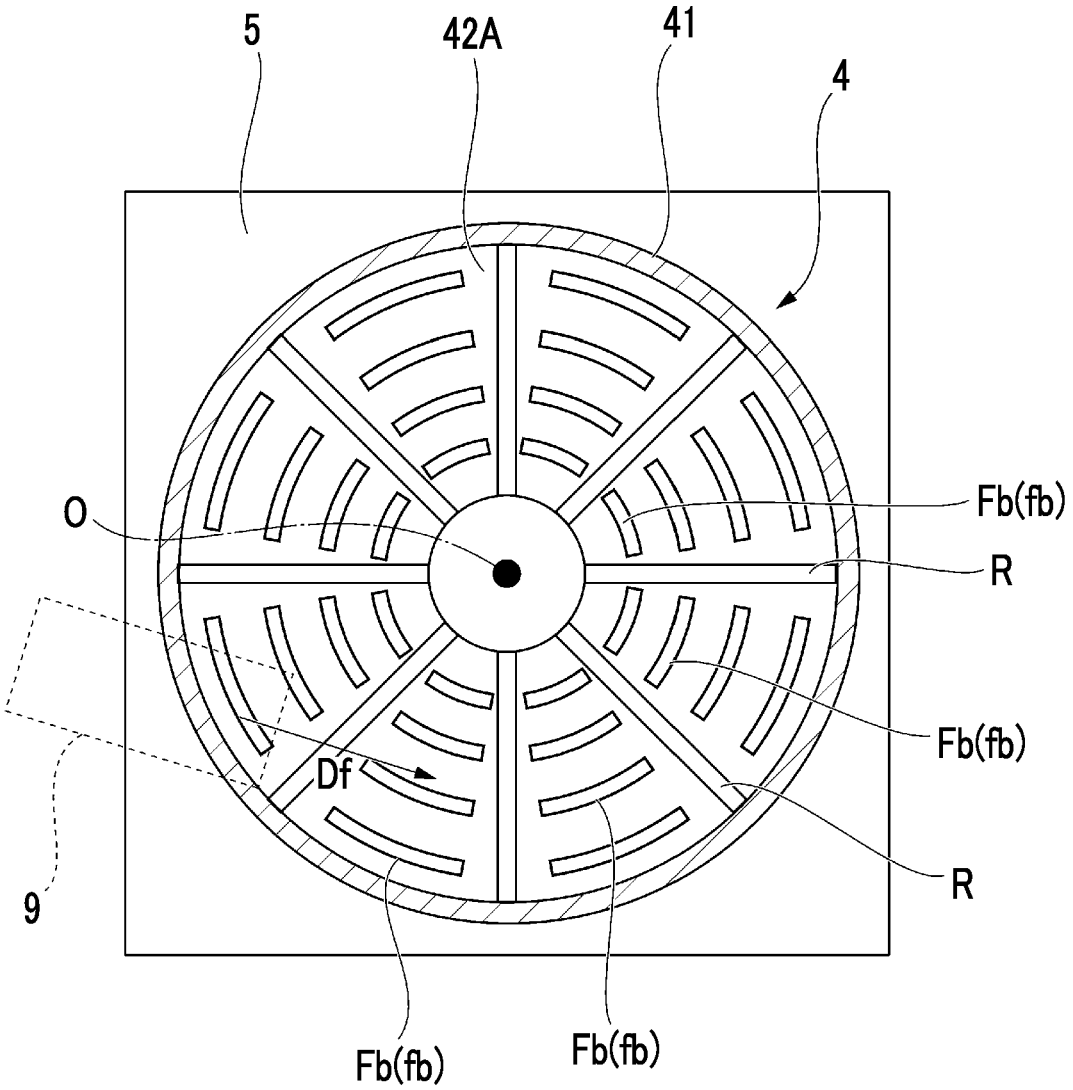
FIG. 4 is a view showing a configuration of a bottom surface of a housing according to a second embodiment of the present disclosure.

As shown in FIG. 4, in the present embodiment, a heat radiating fin Fb extends in the circumferential direction about the axis O and is divided into a plurality of parts in the circumferential direction. That is, the heat radiating fin Fb has a plurality (eight) of fin pieces fb arranged in the circumferential direction. A plurality of rows (four rows) of such heat radiating fins Fb are provided at intervals in the radial direction. The closer the divided heat radiating fin Fb is positioned to the radial outer side, the larger the dimension is in the flowing direction Df. Further, each fin piece fb is provided between a pair of ribs R adjacent to each other in the circumferential direction. In other words, each fin piece fb and each rib R do not overlap each other in the circumferential direction. More specifically, an interval is formed between the fin piece fb and the rib R in the circumferential direction.

With the above configuration, the heat radiating fin Fb is provided between the ribs R. In other words, the heat radiating fin Fb and the rib R do not overlap each other in the circumferential direction. Accordingly, the flow of a refrigerant is disturbed when passing through the rib R, and the refrigerant in an accelerated state collides with the heat radiating fin Fb. As a result, the cooling effect caused by the heat radiating fin Fb can be further enhanced. Further, since the rib R and the heat radiating fin Fb are independent of each other, a thick part is not generated. Accordingly, a probability in which a defect is generated when the housing 4 is formed by casting can also be reduced.

The second embodiment of the present disclosure has been described hereinbefore. It is possible to execute various changes and improvements in the configurations without departing from the gist of the present disclosure.

Third Embodiment

Next, a third embodiment of the present disclosure will be described with reference to FIG. 5. The same configurations as those of each of the embodiments described above will be assigned with the same reference signs, and detailed description thereof will be omitted.

Figure 5:
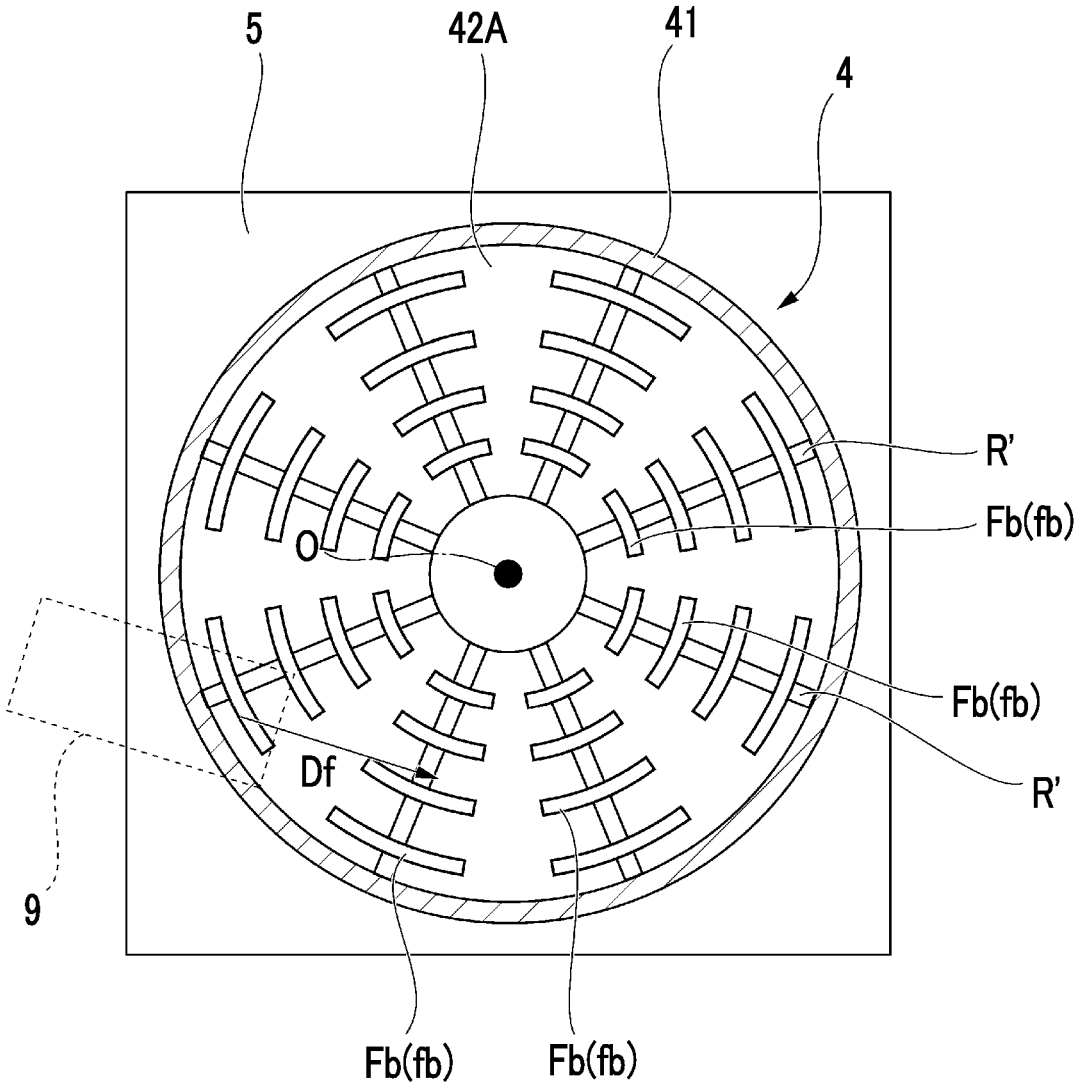
FIG. 5 is a view showing a configuration of a bottom surface of a housing according to a third embodiment of the present disclosure.

As shown in FIG. 5, in the present embodiment, a rib R' is formed at a different position in the circumferential direction with respect to the heat radiating fin Fb which is the same as in the second embodiment. Specifically, each rib R' is formed to overlap the heat radiating fin Fb in the circumferential direction. That is, four fin pieces fb and one rib R' are integrally formed.

With the above configuration, since the heat radiating fin Fb and the rib R' overlap each other in the circumferential direction, the apparent volume of the heat radiating fin Fb increases. Accordingly, the cooling effect caused by the heat radiating fin Fb can be further enhanced. In addition, since a stress which is caused in the heat radiating fin Fb when the bottom surface 42A deforms can be dispersed over the rib R' as well, a probability in which the heat radiating fin Fb is damaged can also be further decreased.

The third embodiment of the present disclosure has been described hereinbefore. It is possible to execute various changes and improvements in the configurations without departing from the gist of the present disclosure.

For example, it is also possible to apply the second embodiment and the third embodiment in combination for each region on the bottom surface 42A.

<Appendix>

The scroll compressor 100 described in each of the embodiments is understood, for example, as follows.

(1) The scroll compressor 100 according to a first aspect includes the shaft 1 that is rotatable about the axis O, the motor 2 that rotationally drives the shaft 1, the compressor body 3 that is driven by the rotation of the shaft 1, the housing 4 that covers the motor 2 and the compressor body 3 and that has the bottom surface 42A facing the motor 2 from the axis O direction, the suction port 9 that guides a refrigerant into the housing 4, and the heat radiating fins F, F', and Fb that are formed on the bottom surface 42A, that extend in the flowing direction Df of the refrigerant, and that are divided into a plurality of parts in the flowing direction Df.

With the above configuration, the heat radiating fin F is formed on the bottom surface 42A, and the heat radiating fins F, F', and Fb are divided into a plurality of parts in the flowing direction Df of the refrigerant. Accordingly, a boundary layer component of a flow along a surface of the heat radiating fin F is split in the flowing direction Df. As a result, the leading edge effect can be obtained a plurality of times for each of the heat radiating fins F, F', and Fb. Therefore, the cooling effect of the bottom surface 42A (housing 4) caused by the refrigerant can be enhanced. (The leading edge effect described herein refers to a phenomenon in which thermal efficiency is highest at a part where a heat medium first collides.)

Further, in a case where the heat radiating fins F, F', and Fb are not divided, there is a possibility in which a great stress is caused between the central portion of each of the heat radiating fins F, F', and Fb and the bottom surface 42A and damages the heat radiating fins F, F', and Fb due to the deformation of the bottom surface 42A. However, with the above configuration, since the heat radiating fins F, F', and Fb are divided into a plurality of parts, a stress which is caused for each of the divided heat radiating fins F, F', and Fb can be kept low even in a case where the bottom surface 42A has deformed. Accordingly, the strength of the housing 4 can be improved.

(2) In the scroll compressor 100 according to a second aspect, the divided heat radiating fins F, F', and Fb positioned in a region where the flow speed of the refrigerant is higher have a larger dimension in the flowing direction Df.

With the above configuration, the dimension of each of the divided heat radiating fins F, F', and Fb (fin pieces f, f', and fb) in the flowing direction Df is larger in a region where the flow speed is higher. Accordingly, the leading edge effect can be generated an appropriate number of times in accordance with a flow speed distribution. As a result, the cooling effect of the bottom surface 42A (housing 4) caused by the refrigerant can be further enhanced.

(3) In the scroll compressor 100 according to a third aspect, each of the heat radiating fins F and Fb extends in an arc shape about the axis O, the plurality of heat radiating fins F and Fb are provided at intervals in the radial direction, and the closer the divided heat radiating fins F and Fb are positioned to the radial outer side, the larger the dimensions are in the flowing direction Df.

With the above configuration, in a case where the flowing direction Df of the refrigerant is the circumferential direction with respect to the axis O, the leading edge effect can be more efficiently generated in accordance with the flowing direction Df.

(4) In the scroll compressor 100 according to a fourth aspect, the heat radiating fin F' extends to the radial inner side from one side toward the other side in the circumferential direction about the axis O, the plurality of heat radiating fins F' are provided at intervals in the circumferential direction, and the closer the divided heat radiating fin F' is positioned to the radial outer side, the larger the dimension is in the flowing direction Df.

With the above configuration, in a case where the flowing direction Df of the refrigerant is a direction toward the radial inner side from the one side in the circumferential direction toward the other side, the leading edge effect can be more efficiently generated in accordance with the flowing direction Df.

(5) The scroll compressor 100 according to a fifth aspect further includes the plurality of ribs R and R' that protrude from the bottom surface 42A and that extend radially about the axis O, and the protruding heights of the ribs R and R' are smaller than the protruding heights of the heat radiating fins F, F', and Fb.

With the above configuration, since the plurality of ribs R and R' are provided, even in a case where a stress is caused at the bottom surface 42A (housing 4) due to a pressure on the suction side, it is possible to sufficiently resist against the stress. Further, the protruding heights of the ribs R and R' from the bottom surface 42A are smaller than the protruding heights of the heat radiating fins F, F', and Fb. Accordingly, a probability in which the flow of the refrigerant at tips of the heat radiating fins F, F', and Fb is obstructed by the ribs R and R' can be reduced.

(6) In the scroll compressor 100 according to a sixth aspect, the heat radiating fin Fb is provided between the pair of the ribs R adjacent to each other in the circumferential direction.

With the above configuration, the heat radiating fin Fb is provided between the ribs R. In other words, the heat radiating fin Fb and the rib R do not overlap each other in the circumferential direction. Accordingly, the flow of a refrigerant is disturbed when passing through the rib R, and the refrigerant in an accelerated state collides with the heat radiating fin Fb. As a result, the cooling effect caused by the heat radiating fin Fb can be further enhanced. Further, since the rib R and the heat radiating fin Fb are independent of each other, a thick part is not generated. Accordingly, a probability in which a defect is generated when the housing 4 is formed by casting can also be reduced.

(7) In the scroll compressor 100 according to a seventh aspect, the heat radiating fin Fb is provided to overlap the rib R' in the circumferential direction.

With the above configuration, since the heat radiating fin Fb and the rib R' overlap each other in the circumferential direction, the apparent volume of the heat radiating fin Fb increases. Accordingly, the cooling effect caused by the heat radiating fin Fb can be further enhanced. In addition, since a stress which is caused in the heat radiating fin Fb when the bottom surface 42A deforms can be dispersed over the rib R' as well, a probability in which the heat radiating fin Fb is damaged can also be further decreased.

INDUSTRIAL APPLICABILITY

The present disclosure relates to the scroll compressor. With the present disclosure, the scroll compressor with improved cooling performance and strength can be provided.

REFERENCE SIGNS LIST

100: scroll compressor
1: shaft
2: motor
3: compressor body
4: housing
4S: inner peripheral surface
5: cover
6: upper bearing
7: lower bearing
8: drive bush
9: suction port
10: shaft body
11: small-diameter portion
12: large-diameter portion
13: eccentric shank
21: rotor
22: stator
31: fixed scroll
31A: first end plate
31B: first spiral plate
32: movable scroll
32A: second end plate
32B: second spiral plate
32C: boss part
41: housing body
42: bottom portion
42A: bottom surface
42B: back surface
43: lid section
A: eccentric axis
Df: flowing direction
f, f', and fb: fin piece
F, F', and Fb: heat radiating fin
F1: outer peripheral heat radiating fin
F2: intermediate heat radiating fin
F3: inner peripheral heat radiating fin
H: opening
O: axis
P: suction flow path
R, R': rib

The invention claimed is:

1. A scroll compressor comprising:
a shaft that is rotatable about an axis;
a motor that rotationally drives the shaft;
a compressor body that is driven by the rotation of the shaft;
a housing that covers the motor and the compressor body and that has a bottom surface facing the motor from a direction of the axis;
at least one fin-group including heat radiating fins that are formed on the bottom surface; and
a suction port that introduces a refrigerant into the housing through an end portion of the suction port in a direction tangential to the heat radiating fins, and
wherein the heat radiating fins included in the fin-group have an arc shape about the axis and are arranged at intervals in a circumferential direction of the housing, and
the heat radiating fins included in the fin-group are placed on the bottom surface only over about half of the circumference around the axis, and an end of a predetermined heat radiating fin in the fin group opposes the end portion of the suction port, such that the refrigerant from the end portion of the suction port is directed along the predetermined heat radiating fin.

2. The scroll compressor according to claim 1,
wherein a plurality of fin-groups each including the heat radiating fins are provided at intervals in a radial direction of the housing, and
wherein the heat radiating fin included in a first fin-group is larger for the length than the heat radiating fin included in a second fin-group positioned at a radial inner side of the first fin-group.

3. The scroll compressor according to claim 1, further comprising:
a plurality of ribs that protrudes from the bottom surface and that extends radially about the axis,
wherein a protruding height of the rib is smaller than a protruding height of the heat radiating fin.

4. The scroll compressor according to claim 3,
wherein the heat radiating fins are provided to overlap the ribs in a circumferential direction.

* * * * *